United States Patent [19]

Smith et al.

[11] Patent Number: 5,028,079

[45] Date of Patent: Jul. 2, 1991

[54] NON-CRUSHING WELLHEAD

[75] Inventors: L. Dean Smith, Fritch; H. Milton Hoff, Houston, both of Tex.

[73] Assignee: J. M. Huber Corporation, Rumson, N.J.

[21] Appl. No.: 422,490

[22] Filed: Oct. 17, 1989

[51] Int. Cl.[5] ..... E21B 33/04

[52] U.S. Cl. ..... 285/144; 285/147; 175/423

[58] Field of Search ..... 285/144, 141, 145, 146, 285/147, 148; 175/423; 188/67; 166/85, 382, 141

[56] References Cited

U.S. PATENT DOCUMENTS

| | | | |
|---|---|---|---|
| 2,312,476 | 3/1943 | Penick et al. . | |
| 2,712,455 | 10/1952 | Neilon . | |
| 2,889,886 | 6/1959 | Gould . | |
| 3,084,745 | 4/1963 | Floyd . | |
| 3,130,987 | 4/1964 | Johnson | 285/146 |
| 3,188,118 | 6/1965 | Jones | 285/147 |
| 3,209,829 | 10/1965 | Haeber . | |
| 3,299,958 | 1/1962 | Todd . | |
| 4,167,279 | 9/1979 | Lucksinger | 285/144 |
| 4,499,950 | 2/1985 | Watkins | 285/144 |
| 4,541,490 | 9/1985 | Bigbie et al. . | |
| 4,678,209 | 7/1987 | Guice | 285/144 |

OTHER PUBLICATIONS

McEvoy SB-3 Casing Hanger Brochure, pp. 36-37.

Ray, Randall, Casing Suspension Loads for Huber-Hercules Type CJ Heads, Feb. 25, 1982.

*Primary Examiner*—Eric K. Nicholson

*Attorney, Agent, or Firm*—Alec H. Horn; Harold H. Flanders; Robert L. Price

[57] ABSTRACT

An improved slip suspension wellhead is disclosed for suspending a selected tubular member inside another without crushing. An inclined support surface is provided with a second support surface which may contact a portion of the slip assembly to halt axial movement of the slips relative to the wellhead body. The second support surface is placed along the inclined support surface at a pre-selected point in order to stop the radial movement of the slip gripping faces before the inner slip diameter is compressed below the sum of the drift diameter plus two times the maximum wall thickness for the selected tubular member. Therefore, the improved wellhead may utilize slips having substantially reduced axial length without danger of crushing the tubular member.

21 Claims, 2 Drawing Sheets

NON-CRUSHING WELLHEAD

This invention relates to a slip suspension wellhead for supporting one tubular member inside of another and, more particularly, relates to an improved gripping apparatus for controllably grasping such members within a wellhead without crushing or crimping the suspended tubular member.

In the drilling and construction of an ordinary oil well, a well bore is begun and surface casing is set or cemented in place. A casing head is then installed on the upper end of the surface casing and the well bore is extended therethrough.

When the drilling operation is finished, the well is ready for completion. The drill pipe is removed and one or more strings of tubular casing are lowered into operating position. In a typical installation of this type, a first casing head is connected to the upper end of the surface casing string by means of threaded, flanged or welded connection. This first casing head suspends an inner casing string within the surface casing string. A second wellhead may be similarly connected to the upper end of the inner casing which suspends a tubing string. In this fashion within the casing string there may be a plurality of tubular member strings each concentrically suspended within another.

By way of explanation, the term "slip suspension wellhead" includes casing heads , tubing heads or any other hanger for suspending one tube within another by means of slip suspension. The terms "tubing" and "casing" do not intrinsically describe a tubular member but more accurately reflect the purpose to which the tubular member is applied. However, for simplicity and as common convention in the industry, casing shall be defined as a tubular member with a nominal outside diameter of 4½" or more and tubing shall be defined as a tubular member with a nominal outside diameter of 4½" or less.

Conventionally, each slip suspension wellhead, whether a casing head or a tubing head, includes arcuate wedge-shaped slips which slide down an inclined support surface on the interior of the bore of the wellhead to grip the string of tubular members to be suspended. These slips act to grip a tubular member of the string by traveling down this inclined surface to wedge between the wellhead body and the tubular member using the weight of the string to further wedge and grip the tubular member. The tubular member gripped by the slips is commonly referred to as the landing joint. Under ideal conditions, the weight of the string which may be is suspended is limited only by the tensile strength of the tubular member or the strength of the threaded joint which connects tubular members in the string.

However, it is well known that as the axially downward force on the gripped tubular or landing joint increases, the compression force from the conventional slip also increases, causing, in some cases, crushing or crimping of the landing joint. If crushing occurs, the internal passageway of the landing joint tubular is restricted. If this restriction is less than the "drift diameter" of the tubular member, the restriction becomes a hanging point for conventional oil tools, particularly tools which are designed according to the drift diameter of the tubular member. This restriction makes the passage of such tools impossible. Accordingly, a crushed tubular member must be replaced.

The problem of crushed or deformed landing joints is well known, and many attempts have been made to solve this problem. One method of minimizing crushing by the slips is to maximize the gripping surface area of the slip which is in contact with the landing joints. This distributes the compressive forces over a larger area and decreases the likelihood of crushing. One shortcoming of this solution is that the overall size and cost of the wellhead must be increased to accommodate these larger slip segments.

A second technique used to avoid crushing in conventional wellheads is to limit the downward force to which the tubular member is exposed. This may be done by limiting the length of tubing string suspended. This second method is unsatisfactory because it limits the depth that a selected tubular string may be suspended. Many manufacturers of wellheads recommend that if slip-type suspension is used, the maximum load on the tubular member string should be no more than about 50–70% of the minimum threaded joint strength that for the selected tubular joint.

A third approach used to avoid crushing the landing joint is to use a tubular member that is made of stronger and more expensive steel and that may have much thicker walls. This approach is acceptable, but one disadvantage of a thicker wall landing joint is that it restricts passage of objects throughout the entire length of the tubular member because of its smaller inside diameter. Obviously, this limits the size of tools which may pass-through the landing joint during the completion and workover of wells.

Another approach which has been attempted employs extended length slips which extend down the annulus between the suspended member and the wellhead. This technique is discussed in U.S. Pat. No. 3,188,118 to Jones. This approach merely attempts to further maximize the slip contact area without further increasing the size of the wellhead required.

Another approach which has been attempted with varying success is the use of double-toothed, controlled-friction slips within the wellhead. Double-toothed slips have rows of teeth on the gripping face of the slip which is in contact with the tubular member, and teeth-like serrations on the slip surface which is in slidable contact with the inclined support surface. These serrations increase the friction between the slip and the inclined support surface to resist downward motion of the slips. One disadvantage of this arrangement is that these serrated teeth on the inner face of the slips tend to gaul the inclined surface. Consequently, after repeated installations these teeth may hang on a previously made grooves and result in slippage of the suspended tubular member. Another disadvantage of double-toothed slips is that manufacturing rows of teeth on both surfaces of the slip assembly is expensive.

Currently, the most commonly used approach to avoid crushing employs a combination of very large slips to maximize the compression surface area, limitations on the tubular member tensile load, and the occasional use of high strength and/or heavier wall landing joints.

These and other disadvantages of the prior art are overcome by the present invention which is described herein.

SUMMARY OF INVENTION

A slip suspension wellhead for axially suspending a selected tubular member in a well bore is disclosed. The tubular member has a nominal outer diameter, a drift diameter and a nominal wall thickness. This wellhead comprises a cylindrical body which has a bore hole with a first axis for passing the tubular member therethrough. The cylindrical body further has formed therein a substantially conical inclined support surface.

A plurality of substantially wedge-shaped slip segments are linked together to form a circular slip assembly having a variable inner diameter. Each slip segment of the slip assembly has an arcuate gripping face substantially axially parallel to and radially concentric with the first axis for gripping contact with the tubular member. Further, each segment of the slip assembly has an inclined slip surface radially outward of the gripping face and adjacent to the inclined support surface. In addition, each segment of the slip assembly has an engagement surface on the slip segment for engagement with a second support surface.

The inclined support surface previously described within the cylindrical body includes a first support surface which has an angle of inclination less than about 15° from the first axis. This permits the first support surface to slidably engage the inclined slip surfaces of the slip assembly so that movement of the slip assembly along the inclined support surface results in radial movement of the gripping faces of the slip segments. Further, the inclined support surface has a second support surface for stopping the axial movement of the slip segment relative to the inclined support surface. The above described engagement surface engages the second support surface when the distance across the gripping faces of opposing slip segments is greater than the sum of the drift diameter plus two times the nominal wall thickness for the selected tubular member.

It is an object of the present invention to provide a wellhead having a shortened slip length such that the overall size of the wellhead may be decreased.

It is another object of the present invention to provide a wellhead which is incapable of crushing a suspended tubular member at any axial load which the joints of the string of tubular members may withstand.

It is yet another object of the present invention to provide a wellhead having a reduced size without sacrificing strength.

It is yet another object of the present invention to provide a wellhead with minimal hoop stresses which are transferred from the axial load to the wellhead without increasing the radial load from the slips to the body.

It is yet another object of the present invention to provide a wellhead requiring reduced slip lengths than conventional wellheads while increasing the crush resistance of the wellhead.

The various objects of the present invention will be fully understood from the following detailed description of preferred embodiments of the present invention, throughout which description references are made to the accompanying drawings.

DETAILED DESCRIPTION OF BEST MODE OF THE PRESENT INVENTION

Figure 1:
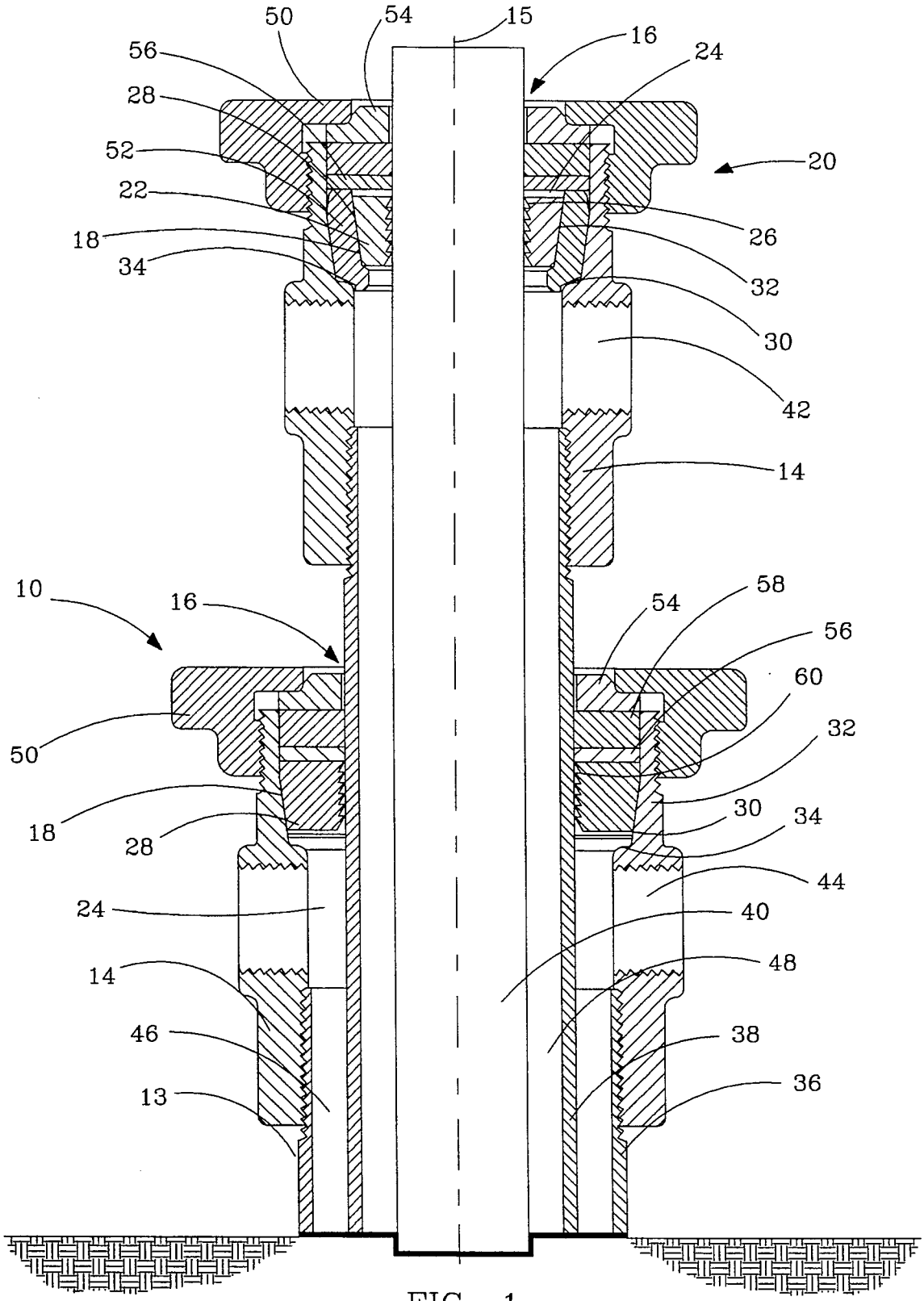
FIG. 1 is an elevation view in cross section of two wellheads of the present invention.

Referring now to FIG. 1, there may be seen two screw-type, slip suspension wellheads of the present invention as they would be used in a production well. Two wellheads, a casing head (10) and a tubing head (20), are shown. Each wellhead includes a substantially cylindrical body (14), with an axial borehole (16) having a first axis therethrough, extending downwardly and threadedly attached to the upper end of a section of casing or tubing, respectively. It is understood that hangers or heads of the present invention may be made with many alternative top and bottom configurations including female threaded connection (as shown), a male threaded connection, a flanged connection or a welded connection.

A conduit tubular member, such as a string of tubing (40) or inner casing (38), extends through the wellhead and into the well bore (13) which has in place an outer casing (36). These tubular members (38,40) may act to convey fluid petroleum or other product to an outlet (42) or (44). Typically, a tubular string includes 30 foot tubular sections which are threadedly joined together by couplings (not shown). An annulus (46) is formed between outer casing (36) and inner casing (38), and another annulus (48) is formed between inner casing (38) and tubing (40). In this manner multiple annuli may be established between a plurality of concentric tubular members, each suspended within another by a wellhead.

Casing head (10) includes outlets (44) which can be used as outlets for gas production or inlets for brine water used to kill the well during a reworking operation. Likewise, tubing head (20) has outlets (42) which may be used for similar purposes. A bore hole (16) passes axially throughout the length of the body (14) which has disposed therein a substantially conical inclined support surface (18) on the interior of the body. Each head (20,10) includes a male threaded top portion on the body (14) to which is matingly attached a female threaded top cap (50). Resting on the inclined support surface (18) are slip segments (22) which are pivotally linked together, one to the other, in a conventional manner (e.g. hinged) to form a circular slip assembly (24). The slip assembly of casing head (10) illustrates the position of the slip segments under low load conditions.

In the example of tubing head (20), a removable slip bowl (52) is placed between the slip assembly (24) and the body (14). By varying the thickness of the slip bowl (52), the nominal size of the tubing (40) which may be accommodated using the same body (14) can be varied without substantially increasing the mass of each slip segment.

Casing head (10) illustrates a wellhead without a slip bowl in place. In this embodiment the inclined support surface (18) is established directly on the body (14) of casing head (10), whereas in the case of tubing head (20) the inclined support surface (18) is established within the inner surface of the slip bowl (52). For convenience, the radially outward surface of slip bowl (52) may be made in such a manner to conform to and mate with the interior surface of body (14) which is formed to establish the inclined support surface for nominal tubing sizes where a slip bowl is not required. The slip assembly of tubing head (20) illustrates the position of slip segments under high load conditions.

Disposed between the slip assembly (24) and the cap (50) are packing means such as a top packing ring (54), an intermediate elastomeric packing ring (58) and a bottom packing ring (56). The top and bottom packing rings (54,56) are typically metallic. The cap (50) provides an adjustable force downwardly acting on the top packing ring (54) which compresses the elastomeric packing ring (58) against bottom ring (56) to create an annular seal against the tubular member which isolates the upper area of the head (20,10). As discussed in more detail later, the wedging action of the slip segments (22) between the inclined support surface (18) and the tubular member act to grip the respective tubular member (40,38). In some embodiments of the present invention the cap (50) of either wellhead types may be replaced with other components, such as a flange, for attachment of further mechanisms such as blow-out preventers, production valves, spools and other production heads.

Referring now to the inclined support surface (18), it may be seen that this inclined support surface is divided into two distinct surfaces, first support surface (32) and second support surface (34). The second support surface (34) may be located on the end of the inclined support surface axially adjacent the well bore (i.e., on the bottom) as illustrated in FIG. 1. Alternatively, the second support surface may be located on the end of the surface (18) axially away from the wellbore (i.e., on the top). If desired, the second support surface may be located in both places although this is not preferred.

The slip segments (22) of the slip assembly (24) have their radially outward surface similarly divided into two surfaces which congruently mate with support surfaces (32) and (34). These radially outward slip surfaces are inclined slip surface (28) and slip engagement surface (30). Slip engagement surface (30) may be located at the top or bottom of inclined slip surface (28) as required to engage second support surface (34).

An alternative, although not preferred, embodiment of inclined slip surface (28) would include serrations to increase the friction along the first support surface (32). This variation is believed to be unnecessary to accomplish the objects of the present invention.

Each slip segment (22) has an arcuate gripping face (26) substantially axially parallel to and substantially radially concentric with the first axis and located on the radially inward surface of the slip segment. This gripping face, typically toothed, is for gripping engagement with the tubing member (40,38) when the slip assembly (24) is compressed radially inward about the tubular member (40,38).

It should be kept in mind that the radial travel distance of the slip assembly is very small in relation to the distance between inner gripping face of radially opposing slip segments. Often this radial travel is not perceptible to the human eye.

Therefore in operation, when the conical slip assembly (24) is in place to provide a slightly variable effective inner diameter between opposing slip segments and the gripping face (26) is in contact with a tubular member, axially downward motion of the tubing member relative to the wellhead will result in inclined slip surface (28) sliding axially downward and radially inward along the first support surface (32). As the slip assembly travels down the first support surface (32), the wedging action of the substantially wedge-shaped slips causes the gripping face (26) to compress and bite into the tubular member. If the axially downward motion of the tubular member continued, the slip assembly would continue to exert a greater and greater radially compressive force until either the axially downward motion ceased or the tubular member was crushed.

It is a critical feature of the present invention that slip engagement surface (30) engages the second support surface (34) at a pre-selected point so that further radial compression is not permitted beyond a pre-selected distance regardless of the axially downward force. When engagement surface (30) of a slip segment is in full contact with second support surface (34) of the inclined support surface (18), the downward weight load of the tubular member is transferred from the slip segment (22) to the body (14) and ultimately to the earth.

If this second support surface were absent, the axial load on the tubular member would be transferred substantially radially outward to the body to produce very significant hoop stress on the body (14) and also transferred radially inward to the tubular member to produce excessive compression forces. However, when the slip assembly (24) is in engagement with second support surface (34), a significant portion of the load is now transferred axially downward along body (14) thereby greatly reducing the exposure of body (14) to radial hoop stress and eliminating excessive compression which causes crushing.

In light of the above discussion, it is apparent that the precise placement of engagement surface (32) on second support surface (34) is very important. Second support surface (34) and engagement surface (30) should engage at a pre-selected point as to cause the complete and abrupt cessation of axially downward motion after sufficient gripping force is attained but before the tubular member is deformed below the "drift diameter" for that nominal size tubular member.

It has been found desirable that the angle of inclination of the conical second support surface (34), and correspondingly, slip engagement surface (30), be substantially between 30° to 90°. As the angle of inclination of the second support surface approached 90°, occasionally objects passing through the wellhead may catch. If the angle is much below 30°, it becomes more difficult to achieve a complete cessation of motion. Therefore, it has been found more preferred to have the conical surface (30, 34) at an angle approximately 45 degrees from the axis of the bore hole (16) through the body (14). This provides complete cessation of slip motion without providing a ledge that may snag a passing object.

In contrast, the angle of inclination of the first support surface (32) which slidably contacts the inclined slip surface (28) should have an angle of inclination of less than about 15 degrees from the axis defined by the bore hole (16) through the body (14). In this manner, the inclined slip surface (28) of the slip assembly and the first support surface (32) may be in sliding contact so that movement of the slip assembly along the first support surface results in a convenient rate of radial movement of the gripping surfaces of the slip segments. In practice a first support surface having an angle of inclination of approximately 5° to 15° has been preferred to provide an acceptable ratio between axial movement of the tubular member and radial movement of the slip assembly. An angle of inclination of 7°–10° has been found more preferred with substantially 8° most preferred.

It has been found that the second: support surface (34) should be placed along the inclined support surface (18) at such a point that the second support surface and the slip engagement surface (30) fully contact when the slip assembly effective inner diameter is not less than the sum of the drift diameter, plus two times the nominal wall thickness of the selected tubular member. In this manner the gripping face is permitted sufficient radially inward travel to grip the pipe but not sufficient travel to crush the pipe below the manufacturer's published drift diameter.

Manufacturers of tubular goods conventionally used in oilfield operations maintain certain very strict dimensional controls. However, if the outside diameter of a tubular member were to vary even to a small degree from nominal, without being compensated for, slip assembly (24) may stop radially inward motion before adequate gripping pressure was attained causing the slips to drop the tubing. This could be catastrophic. Accordingly, it is a feature of the present invention, that certain nominal dimensions maintained by the manufacturers of tubular goods may be used to determine the placement of engagement surface (30) along the inclined support surface (18) and thereby avoid this occurrence. This placement of the engagement surface inherently builds in a compensating mechanism for varying dimensions without risking either excessive radial force or dropped tubing.

Certain nominal dimensions of tubular goods are particularly guaranteed within strict tolerances by manufacturers according to American Petroleum Institute (API) standards. A first important dimension is the "drift diameter". The drift diameter for a selected tubular member is the diameter of a solid cylindrical drift gauge which the manufacturer specifies will pass unobstructed throughout the length of the tubular member. This drift gauge is from 6–12 inches in length for casing and 42 inches in length for tubing with a precisely machined outer diameter. Obviously this drift diameter takes into account, not only variations in the tubular inside diameter, but variations in the internal straightness of the tubular member, i.e. not just a guaranteed inside diameter at a particular point but a guaranteed diameter over a unit length.

A second dimensional value which is accurately maintained is nominal wall thickness. This means that at no point will the thickness of the wall be more than nominal or less than 87.5% of nominal. For this reason nominal wall thickness is the same as maximum wall thickness. Accordingly, if the inside diameter of a selected tubular member were exactly equal to the drift diameter, and the wall thickness were exactly as published, then the outside diameter of the tubular member would also be very exact. This is not necessarily so.

As previously stated, the internal drift diameter is a minimum distance which the manufacturer specifies over a given length of tubing. In order to achieve this specification tubular members having slightly greater internal dimensions than the drift diameter are required to compensate for manufacturing tolerances and lack of straightness. A slightly greater internal dimension affords a safety factor to guarantee the passage of a drift diameter test cylinder. Therefore, even if the wall thickness were constant, the outside diameter of a tubular member might vary from section to section and even from one portion of a section to another.

It should be again remembered that the present invention prevents a section of a tubular member from being compressed or crushed below the drift diameter for that selected tubular member. Accordingly, if internal deflection were less than sufficient to bring the tubular member below the drift diameter, no harm would occur in operation. It is this recognition that permits the exact placement of the second support surface along the inclined support surface.

For illustration purposes, two extreme situations will be described. If the actual inside diameter of a selected tubular member is at the maximum permitted above the drift diameter and the actual wall thickness is within acceptable tolerances, the outside diameter of the tubular member will be oversized. In this case, the teeth (60) of the gripping faces of the slip segments would penetrate or bite into the surface of the tubular member a conventional distance and suspend the tubular member.

If the downward axial force on the tubing was not very great, the teeth (60) would hold the tubing and the engagement surface (30) would stop short of the second support surface (34). If the downward axial force on the tubing were sufficiently great, the downwardly axial motion would continue. The slip assembly would be permitted to slide further down the first support surface (32) and the teeth (60) would bite further into the tubular member, even to the point of small deformation. However, because of the precise placement of the second support surface as described earlier, this deformation of the tubular member must stop before the drift diameter is reached as a result of contact of the engagement surface with the second support surface. Remember that in this situation the actual internal diameter is at the greatest permitted, leaving adequate room for the drift gauge.

In another instance, if the inside diameter of the tubular member is as small as permitted (i.e., exactly the drift diameter plus a minimal tolerance) and the wall thickness is also at the minimum of the manufacturing tolerance range, it follows that the outside diameter of the tubular member is undersize. With the second support surface placed along the inclined support surface as taught by the present invention, the radial motion is such that the slip teeth just engage and bite into the outer surface of the tubular member when it is stopped by the contact between engagement surface (30) and the second support surface (34). Accordingly, this undersized pipe is gripped sufficiently to hold any desired axial load without any deformation so that the drift diameter is protected. Using this recognition of manufacturing tolerances within selected nominal dimensions, the point at which the gripping faces of the slip assembly must stop all radial, and therefore all axial, motion may be easily calculated for each nominal size tubular member. It is a feature of the present invention that the distance between the tips of the teeth of opposing gripping faces (effective inner diameter) of the slip assembly should never be allowed to be compressed below the sum of the drift diameter plus two times the nominal maximum wall thickness for the selected tubular member before being stopped by the second support surface.

An example calculation for a wellhead for suspending nominal 2⅜" EUE tubing having a 4.70 lbs./per foot API rating is set forth below. Such a tubular member has a nominal wall thickness ($W_{nom}$) of 0.190 inches, and a drift diameter ($D_{drift}$) of 1.901 inches.

The minimum permitted distance across opposing gripping faces (Slip $ID_{min}$) is the diameter from tooth to tooth inside the slip when the slip engagement surface is in full contact with the second support surface. This distance is calculated by:

$$\text{Slip } ID_{min} > D_{drift} + 2\,(W_{nom}) \quad \text{(I)}$$
$$> 1.901 + 2\,(0.190)$$
$$> 2.281 \text{ inches}$$

Other nominal $2\frac{3}{8}''$ tubing drift diameters may range from 1.773 to 1.907 inches and the nominal wall thickness may range from 0.190 to 0.254 inches. However, using the above formula, it is observed that for all $2\frac{3}{8}''$ tubing the minimum slip ID remains constant. This is believed true for all tubing and casing tubular members having the same nominal outside diameter.

Therefore, for this selected tubing the second support surface (34) should be placed such that the slip engagement surface (30) is in full contact before the circular slip assembly is compressed to a diameter of 2.281".

It is preferred that a tolerance factor (F) be introduced to compensate for manufacturing variation in the wellheads of the present invention. For tubing this tolerance factor has been chosen to be between 0 to 0.094 inches although between about 0.03–0.06 inches is more preferred. A tolerance factor of about 0.045 inches has been found to be adequate. For casing, this tolerance factor has been chosen to be between 0 to 0.125 inches although between about 0.040–0.080 inches is more preferred. A tolerance factor of about 0.06 has been found to be adequate. It should be kept in mind that as the tolerance factor increases, the possibility of dropping a tubular member also increases. Accordingly, a preferred embodiment of the wellhead described above would have a minimum slip ID of:

$$Slip\ ID_{min} = D_{drift} + 2(W_{nom}) + F \quad \text{(II)}$$

wherein the tolerance factor is from 0–0.094 inches for tubing and 0–0.125 inches for casing.

Therefore, a preferred wellhead for suspending $2\frac{3}{8}''$ tubing and having a tolerance factor of 0.045 inches would have the second support surface placed to fully contact the engagement surface when the circular slip assembly has been compressed to an inner diameter of 2.325 inches.

Using conventional engineering techniques and taking into account the thickness of the slips, the angle of inclination and the maximum inside diameter of the bore hole or slip bowl, it is now possible to calculate the exact point to place the second support surface along the inclined support surface (34) for any desired configuration. A table giving preferred minimal slip ID for selected nominal OD tubular members is set forth below:

| Nominal OD | lbs/ft | $D_{drift}$ | $W_{nom}$ | F | Slip $ID_{min}$ |
|---|---|---|---|---|---|
| $2\frac{3}{8}''$ | 4.70 | 1.901 | 0.190 | 0.30–.060 | 2.311–2.341 |
| $2\frac{7}{8}''$ | 6.50 | 2.347 | 0.217 | 0.30–.060 | 2.811–2.841 |
| $3\frac{1}{2}''$ | 9.30 | 2.867 | 0.254 | 0.040–0.080 | 3.415–3.455 |
| $4\frac{1}{2}''$ | 9.50 | 3.965 | 0.205 | 0.040–0.080 | 4.415–4.455 |
| $5\frac{1}{2}''$ | 14.0 | 4.887 | 0.244 | 0.040–0.080 | 5.4–5.45 |
| $8\frac{5}{8}''$ | 24.0 | 7.972 | 0.264 | 0.040–0.080 | 8.540–8.580 |

Figure 2:
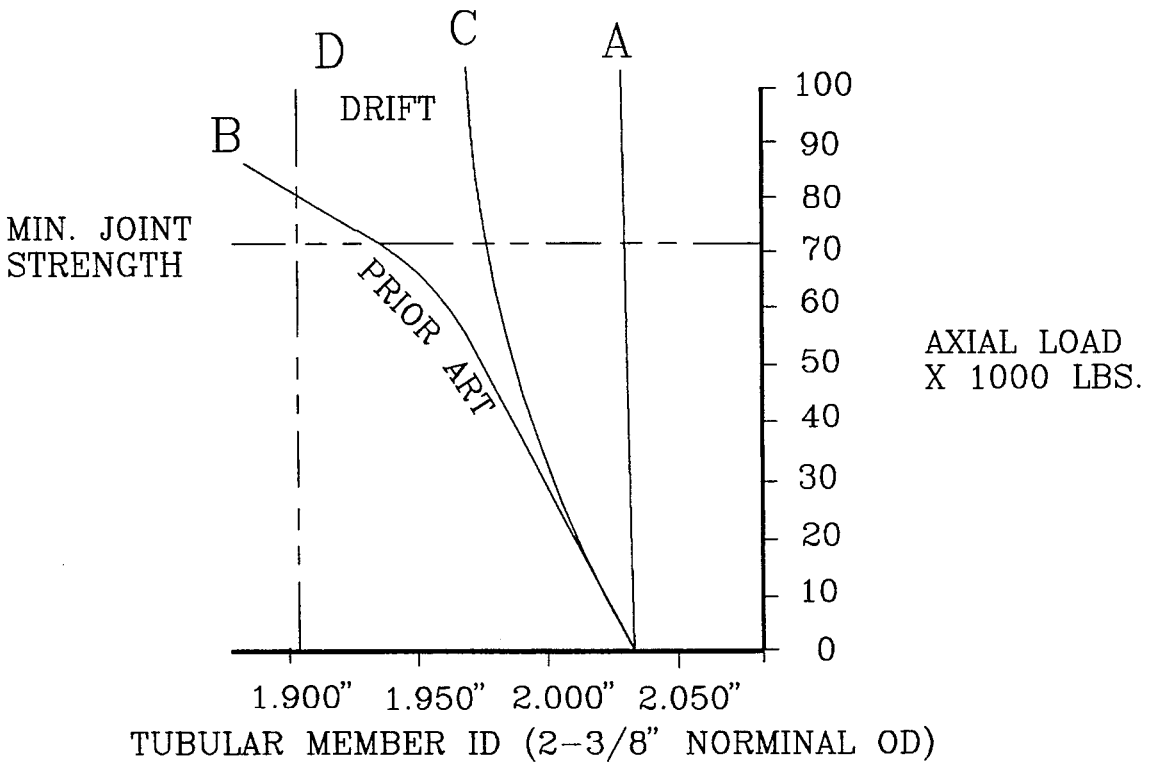
FIG. 2 is a graph comparing deformation of tubing in a wellhead of the present invention with a wellhead of the prior art.

Referring now to FIG. 2, there may be seen a graph illustrating the results of load testing on wellheads used for suspending $2\frac{3}{8}''$ tubing. Example A represents the performance of a machined prototYpe of a wellhead of the present invention having gripping faces with an axial length of $1\frac{1}{2}''$ incorporating a tolerance factor of 0.025 inches. Example B represents the performance of a conventional wellhead of the prior art having gripping faces with a slip length of 5". Example C represents the performance of a wellhead of the present invention suitable for mass production having gripping faces with an axial length of $1\frac{1}{2}''$ and incorporating a tolerance factor of substantially 0.054 inches. It should be noted that the prior art wellhead (Example B) has more than three times the gripping surface area than the wellheads of Examples A and C.

Samples of tubing or casing were cut from the same section of tubular member and placed in wellheads to be tested. To assure repeatability in the testing procedure, the height of the tubular member above the slip assembly was set equal to the diameter of the tubular member. Further, the total length of the tubular sample was held constant ensuring a constant distance below the slip assembly. A metal plug was welded onto the bottom of each of the test pieces and a set of ring gauges were machined at selected diameters. The wellheads, including tubular sample, were assembled and the largest gauge for that particular tubular member was placed inside the tubular and a $2\frac{3}{4}''$ solid round shaft, 18" long, was placed inside the tubing sample to the center of the plug.

A suspended load was simulated by placing the assembled wellhead in a hydraulic press with the load applied atop the round shaft. Loads were applied in increments, but in all cases the load was not increased until the slip segments were moving downward at no more than 0.0001" per minute. A ring gauge was passed throughout the length of the tubular sample. If the ring gauge would not pass, the next smaller gauge was passed through the sample. In this manner the deformation of the inside diameter of the tubing versus the axial load could be determined.

In the case of FIG. 2, all tubing samples were cut from the same joint of $2\frac{3}{8}$"0 nominal OD K-55 tubing having an API rating of 4.70 lbs/ft. The performance of machined slip assemblies with a machined slip bowl differed from cast, mass production slip assemblies as a result of the casting tolerances and the incorporation of a different tolerance factor. In Examples A and C, the tubing sample broke at 95,000 to 100,000 lbs. indicating this particular tubing sample substantially exceeding API minimum joint strength requirements. The wellhead of the prior art crushed the tubing below the drift diameter at approximately 82,000 lbs. Again remember that in the prior art wellhead the radial compression forces were dispersed over three times the surface area of the wellhead of the present invention.

In other tests, slip segments having only 1" of axial height at the gripping face were found not to crush the tubing below the drift diameter. This represents a difference of five times the gripping surface area between the prior art wellhead and the present invention. It is believed that a conventional wellhead of the prior art with an axial slip gripping surface length of $1\frac{1}{2}''$ would crush the sample at less than $\frac{1}{2}$ the load of Examples A, B, or C.

Because crushing may be prevented by the teachings of the present invention, very large slip segments of the prior art are no longer required. Consequently, the complete wellhead may be substantially reduced in size yet be capable of suspending tubular loads up to the joint strength of the tubular member.

Figure 3:
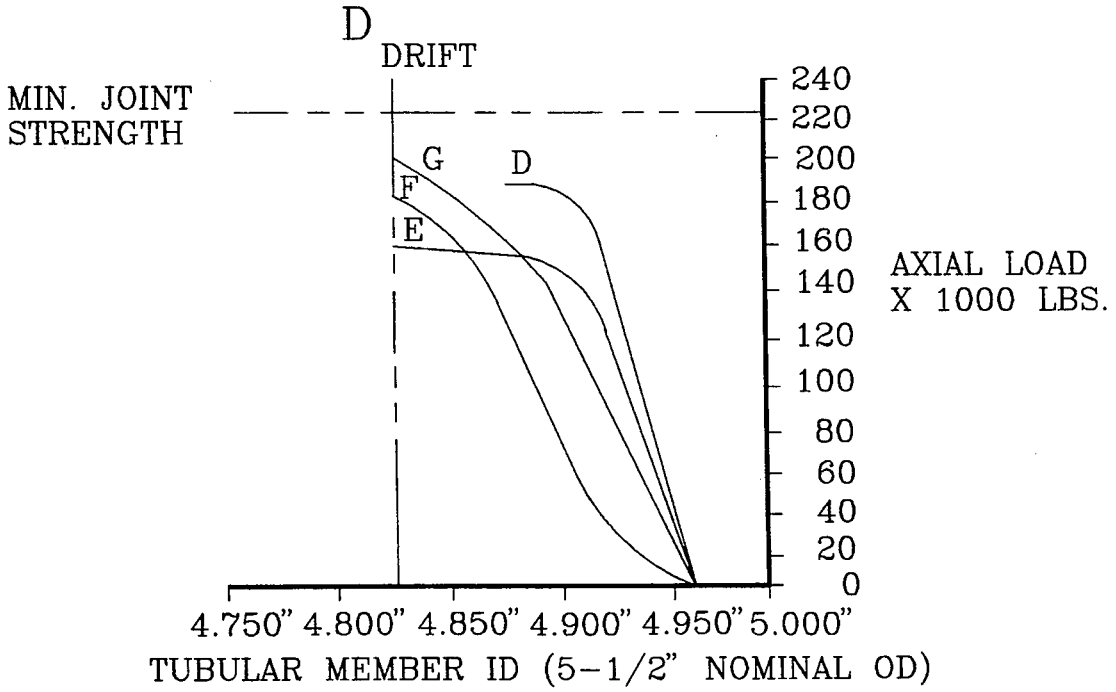
FIG. 3 ( PRIOR ART )
FIG. 3 is a graph illustrating deformation of casing in wellheads of the prior art.

Referring now to FIG. 3, there may be seen a graph illustrating historical casing collapse tests on casing heads of the prior art using the procedure of Examples A–C. In these examples, wellheads D–G suspended 5½" nominal OD J-55 casing having an API rating of 15.5 lbs. per foot. It may be seen that in all cases the prior art wellheads crushed the selected casing below the drift diameter at an axial load well below the API minimum joint strength (222,000 lbs.).

From the foregoing it will be seen that the present invention is well adapted to attain the objects herein above set forth, together with other advantages which are inherent in the apparatus. It is understood that certain features and sub-combinations are of utility and may be employed without reference to other features and sub-combinations. Because many possible embodiments of the present invention may be made without departing from the scope thereof, it is to be understood that all matter set forth or shown in the accompanying drawings is to be interpreted as illustrative and not in a limiting sense.

We claim:

1. A slip suspension wellhead for axially suspending a selected tubular member in a well bore, the member having a nominal outside diameter, a nominal wall thickness and a drift diameter, the wellhead or tubing hanger comprising:

a cylindrical body with a bore hole having a first axis for passing the tubular member therethrough and having formed therein a substantially conical inclined support surface; and a circular slip assembly having a variable inner diameter including a plurality of substantially wedge-shaped slip segments, a) each slip segment of the slip assembly having, (i) an arcuate gripping face substantially axially parallel to and substantially radially concentric with the first axis for gripping contact with the tubular member, (ii) an inclined slip surface radially outward of the gripping face and adjacent to the inclined support surface, and (iii) an engagement surface on the slip segment for engagement with a second support surface; and (b) the inclined support surface including, (i) a first support surface, having an angle of inclination less than about 15° from the first axis, to slidably engage the inclined slip surfaces of the slip assembly so that movement of the slip assembly along the inclined support surface results in radial movement of the gripping surfaces of the slip segments, and (ii) a second support surface for stopping the axial movement of the slip segment relative to the inclined support surface, the engagement surface contacting the second support surface when a distance across the gripping faces of opposing slip segments is greater than the sum of the drift diameter plus two times the nominal wall thickness for the selected tubing member.

2. The wellhead of claim 1 wherein the nominal outside diameter is 2⅞ inches or less and the engagement surface contacts the second support surface when the distance between the gripping faces of opposing slip segments is substantially equal to the sum of the drift diameter plus two times the nominal wall thickness of the selected tubular member plus a tolerance factor substantially between 0 and 0.094 inches.

3. The wellhead of claim 2 wherein the tolerance factor is substantially between 0.030 inches and 0.060 inches.

4. The wellhead of claim 3 wherein the tolerance factor is substantially 0.045 inches.

5. The wellhead of claim 1 wherein the nominal outside diameter is 3½ inches or more and the engagement surface contacts the second support surface when the distance between the gripping faces of opposing slip segments is substantially equal to the sum of the drift diameter plus two times the nominal wall thickness of the selected tubular member plus a tolerance factor substantially between 0 and 0.125 inches.

6. The wellhead of claim 5 wherein the tolerance factor is substantially between 0.040 inches and 0.080 inches.

7. The wellhead of claim 6 wherein the tolerance factor is substantially 0.06 inches.

8. The wellhead of claim 1 wherein the angle of inclination of the first support surface is substantially between 7° and 10°.

9. The wellhead of claim 8 wherein the angle of inclination of the first support surface is substantially between 7½° to 8½°.

10. The wellhead of claim 1 wherein the axial length of the gripping faces of the slip assembly are substantially between 1 to 2 inches.

11. The wellhead of claim 1 wherein the second support surface is located on an end of the inclined support surface axially away from the well bore.

12. The wellhead of claim 1 wherein the second support surface is located on an end of the inclined support surface axially adjacent the well bore.

13. The wellhead of claim 1 wherein the cylindrical body has disposed therein a substantially conical slip bowl for establishing the radial location of the inclined support surface, the slip bowl removably secured within the borehole and having the inclined support surface on the radially inward surface of the slip bowl and adjacent to the inclined slip surface and the slip engagement surface, and an attachment surface on the radially outward surface of the slip bowl and substantially congruent with and adjacent to the radially inward surface of the cylindrical body, for removably securing the slip bowl within the borehole.

14. The wellhead of claim 13 wherein the radially inward surface of the cylindrical body establishes a second inclined support surface for a second tubular member having a larger nominal outside diameter than the first selected tubular member when the slip bowl is removed.

15. The wellhead of claim 1 wherein the nominal outside diameter of the tubular member is 2⅜ inches and the distance across the gripping faces of opposing slip segments is substantially between 2.311 inches to 2.342 inches when the engagement surface contacts the second support surface.

16. The wellhead of claim 1 wherein the nominal outside diameter of the tubular member is 2⅞ inches and the distance across the gripping faces of opposing slip segments is substantially between 2.811 inches to 2.841 inches when the engagement surface contacts the second support surface.

17. The wellhead of claim 1 wherein the nominal outside diameter of the tubular member is 3½ inches and the distance across the gripping faces of opposing slip segments is substantially between 3.415 inches to 3.455 inches when the engagement surface contacts the second support surface.

18. The wellhead of claim 1 wherein the nominal outside diameter of the tubular member is $4\frac{1}{2}$ inches and the distance across the gripping faces of opposing slip segments is substantially between 4.415 inches to 4.455 inches when the engagement surface contacts the second support surface.

19. The wellhead of claim 1 wherein the nominal outside diameter of the tubular member is $5\frac{1}{2}$ inches and the distance across the gripping faces of opposing slip segments is substantially between 5.415 inches to 5.455 inches when the engagement surface contacts the second support surface.

20. The wellhead of claim 1 wherein the nominal outside diameter of the tubular member is $8\frac{5}{8}$ inches and the distance across the gripping faces of opposing slip segments is substantially between 8.540 inches to 8.580 inches when the engagement surface contacts the second support surface.

21. The wellhead of claim 1 wherein the combination of the inclined slip surface and the slip engagement surface form a radially outward slip surface which is substantially congruent with the inclined support surface.

* * * * *